US011268718B2

(12) United States Patent
Minamida et al.

(10) Patent No.: US 11,268,718 B2
(45) Date of Patent: Mar. 8, 2022

(54) REFRIGERATION APPARATUS

(71) Applicant: Daikin Industries, LTD., Osaka (JP)

(72) Inventors: Tomoatsu Minamida, Osaka (JP); Tomoyuki Haikawa, Osaka (JP); Shigeharu Taira, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 38 days.

(21) Appl. No.: 16/492,992

(22) PCT Filed: Mar. 26, 2018

(86) PCT No.: PCT/JP2018/012122
§ 371 (c)(1),
(2) Date: Sep. 11, 2019

(87) PCT Pub. No.: WO2018/181173
PCT Pub. Date: Oct. 4, 2018

(65) Prior Publication Data

US 2020/0049361 A1 Feb. 13, 2020

(30) Foreign Application Priority Data

Mar. 31, 2017 (JP) ..... JP2017-072646

(51) Int. Cl.
*F24F 11/36* (2018.01)
*F25B 49/02* (2006.01)
(Continued)

(52) U.S. Cl.
CPC ..... *F24F 11/36* (2018.01); *F25B 49/02* (2013.01); *F24F 11/89* (2018.01); *F25B 49/005* (2013.01); *F25B 2500/222* (2013.01)

(58) Field of Classification Search
CPC ..... F24F 11/36; F24F 11/89; F25B 2500/222; F25B 49/005
See application file for complete search history.

(56) References Cited

U.S. PATENT DOCUMENTS 5,197,298 A * 3/1993 Kobayashi ..... B60H 1/3225 62/115
6,536,225 B1 * 3/2003 Yajima ..... F24F 1/02 62/407

(Continued)

FOREIGN PATENT DOCUMENTS

EP 3 346 211 A1 7/2018
JP 2000-249435 A 9/2000

(Continued)

*Primary Examiner* — Henry T Crenshaw
(74) *Attorney, Agent, or Firm* — Birch, Stewart, Kolasch & Birch, LLP

(57) ABSTRACT

Provided is a refrigeration apparatus that is capable of determining an increased possibility of ignition due to a refrigerant leak. An air conditioner (100) including a refrigerant circuit (10) includes a refrigerant gas sensor (81) and an oxygen gas sensor (82). The refrigerant circuit (10) has an R32 refrigerant charged therein, and performs a refrigeration cycle. The refrigerant gas sensor (81) detects a refrigerant gas in a room where at least a portion of the air conditioner (100) is located. The oxygen gas sensor (82) detects an oxygen gas in the room.

13 Claims, 8 Drawing Sheets

(51) Int. Cl.
*F24F 11/89* (2018.01)
*F25B 49/00* (2006.01)

(56) References Cited

U.S. PATENT DOCUMENTS

| | | | | |
|---|---|---|---|---|
| 2005/0103029 | A1* | 5/2005 | Kawahara | F25D 29/008 62/126 |
| 2013/0098576 | A1 | 4/2013 | Fujitaka et al. | |
| 2015/0233598 | A1* | 8/2015 | Shikii | F24F 11/79 165/244 |
| 2016/0061469 | A1* | 3/2016 | Albonesi | H02J 3/14 700/276 |
| 2017/0138653 | A1* | 5/2017 | Bahar | C25B 9/00 |
| 2017/0198936 | A1* | 7/2017 | Yamaguchi | F24F 11/74 |
| 2017/0343258 | A1* | 11/2017 | Yamaguchi | F25B 49/02 |
| 2019/0063808 | A1* | 2/2019 | Suzuki | F24F 1/0007 |

FOREIGN PATENT DOCUMENTS

| | | | | | |
|---|---|---|---|---|---|
| JP | 2002-195718 | | * | 7/2002 | |
| JP | 2002-195718 | A | | 7/2002 | |
| JP | 2002-228281 | A | | 8/2002 | |
| JP | 2012-13348 | A | | 1/2012 | |
| JP | 2014006027 | A | * | 1/2014 | F25B 13/00 |
| JP | 2014-35171 | A | | 2/2014 | |
| JP | 2016-70568 | A | | 5/2016 | |
| JP | 2016-200349 | A | | 12/2016 | |
| WO | WO 2017/037841 | A1 | | 3/2017 | |

* cited by examiner

REFRIGERATION APPARATUS

TECHNICAL FIELD

The present disclosure relates to a refrigeration apparatus.

BACKGROUND ART

Recently, a refrigeration apparatus has been required to use a refrigerant having less environmental impact to suppress global warming. Refrigerants having less environmental impact than HFC (hydrofluorocarbon) refrigerants that are widely and conventionally used include low-GWP (global warming potential) refrigerants.

However, many of the low-GWP refrigerants have flammability.

Techniques have been devised that enable detection of a refrigerant leak to address a leak of refrigerant from a refrigeration apparatus. For example, in Patent Literature 1 (Japanese Unexamined Patent Application Publication No. 2000-249435), a method is proposed for, if refrigerant leaks, detecting the leak by using changes in the velocity of sound propagating in air in accordance with changes in the concentration of the refrigerant in the air.

SUMMARY OF THE INVENTION

Technical Problem

However, the method for detecting a refrigerant leak by using changes in the velocity of sound has a problem such as changing the degree of incidence of a reflected sound wave on a microphone depending on the material of a reflection surface from which the sound wave is reflected. Thus, it is difficult to accurately detect a refrigerant leak.

It is also possible to consider the detection of a leak using an electric sensor that is capable of detection when the concentration of refrigerant in air becomes greater than or equal to a predetermined concentration. However, if a very slight leak that does not lead to ignition is detectable, the operation of the refrigeration apparatus may be stopped more than necessary.

In particular, the possibility that ignition occurs when refrigerant leaks does not depend only on the concentration of refrigerant in a leak space. Even if the concentration of refrigerant in the leak space becomes high, no ignition may occur.

The present disclosure has been made in view of the foregoing point, and it is an object of the present disclosure to provide a refrigeration apparatus that is capable of determining an increased possibility of ignition due to a refrigerant leak.

Solution to Problem

A refrigeration apparatus according to a first aspect is a refrigeration apparatus including a refrigerant circuit, and includes a refrigerant gas sensor and an oxygen gas sensor. The refrigerant circuit has refrigerant charged therein and performs a refrigeration cycle. The refrigerant gas sensor detects a refrigerant gas in a target space where at least a portion of the refrigeration apparatus is located. The oxygen gas sensor detects an oxygen gas in the target space.

The refrigeration apparatus may be arranged over two spaces. For example, the refrigeration apparatus may be configured to have an indoor unit mounted in a room, and an outdoor unit mounted outside the room. Alternatively, for example, the refrigeration apparatus may be configured such that a portion thereof directed to the inside of a room and a portion thereof directed to the outside of the room are integrated into a single unit by a single casing.

In the refrigeration apparatus, it is possible to determine the possibility of ignition due to a leak of refrigerant by using both the detection of a refrigerant gas by the refrigerant gas sensor and the detection of an oxygen gas by the oxygen gas sensor. Accordingly, the ignition possibility due to a refrigerant leak can be more accurately determined than the case where only a refrigerant gas is detected.

A refrigeration apparatus according to a second aspect is the refrigeration apparatus according to the first aspect, wherein the refrigerant charged in the refrigerant circuit is a single-component refrigerant that is one of a flammable refrigerant, a low flammable refrigerant, a mildly flammable refrigerant, and an ammonia refrigerant, or a refrigerant mixture of two or more thereof.

Examples of the flammable refrigerant include refrigerants classified in Class A3 of ASHRAE 34 Refrigerant Safety Classification. Examples of the low flammable refrigerant include refrigerants classified in Class A2 of ASHRAE 34 Refrigerant Safety Classification. Examples of the mildly flammable refrigerant include refrigerants classified in Class A2L of ASHRAE 34 Refrigerant Safety Classification.

In this refrigeration apparatus, when a refrigerant that has an ignition possibility when leaking is used in the refrigerant circuit, it is possible to determine the possibility of ignition.

A refrigeration apparatus according to a third aspect is the refrigeration apparatus according to the first aspect, wherein the refrigerant charged in the refrigerant circuit is R32 or a refrigerant with lower GWP than R32.

Examples of the refrigerant with lower GWP than R32 include a natural refrigerant such as R717 and, R170, R1270, R290, R600, R600a, R152a, and a refrigerant mixture of two or more thereof.

In this refrigeration apparatus, when a refrigerant with low GWP (global warming potential) is used in the refrigerant circuit, it is possible to determine the possibility of ignition.

A refrigeration apparatus according to a fourth aspect is the refrigeration apparatus according to any one of the first to third aspects, further including a control unit. The control unit provides a notification indicating that an ignition possibility has occurred, or changes an operation of the refrigeration cycle in the refrigerant circuit or stops the operation of the refrigeration cycle in the refrigerant circuit, on the basis of detected information obtained from the refrigerant gas sensor and the oxygen gas sensor.

The notification indicating that an ignition possibility has occurred includes, for example, but not limited to, a notification provided by outputting a sound, a notification provided by emitting light from a lamp or blinking the lamp, a notification provided by transmitting information indicating that an ignition possibility has occurred to an external device connected via a communication network, or a combination thereof.

The change in the operation of the refrigeration cycle in the refrigerant circuit includes, for example, but not limited to, changing the operating state to interrupt the supply of refrigerant to a leak portion, and changing the operating state to reduce the amount of refrigerant that is circulated by, for example, reducing the driving frequency of the compressor.

In this refrigeration apparatus, the control unit provides a notification indicating that an ignition possibility has occurred, or changes the operation of the refrigeration cycle in the refrigerant circuit or stops the operation of the refrigeration cycle in the refrigerant circuit. Accordingly, it is possible to inform the user that an ignition possibility has occurred or to suppress a further increase of the ignition possibility.

A refrigeration apparatus according to a fifth aspect is the refrigeration apparatus according to the fourth aspect, further including an air temperature sensor. The air temperature sensor detects an air temperature in the target space. The control unit provides a notification indicating that an ignition possibility has occurred, or changes an operation of the refrigeration cycle in the refrigerant circuit or stops the operation of the refrigeration cycle in the refrigerant circuit, on the basis of detected information obtained from the refrigerant gas sensor, the oxygen gas sensor, and the air temperature sensor.

In this refrigeration apparatus, when providing a notification indicating that an ignition possibility has occurred, or changing the operation of the refrigeration cycle in the refrigerant circuit or stopping the operation of the refrigeration cycle in the refrigerant circuit, the control unit performs determination on the basis of detected information obtained not only from the refrigerant gas sensor and the oxygen gas sensor but also from the air temperature sensor. Accordingly, the control unit can perform determination by taking into account the effect of the air temperature in the target space on the ignition possibility (such as taking into account that the higher the air temperature is, the higher the ignition possibility becomes).

A refrigeration apparatus according to a sixth aspect is the refrigeration apparatus according to the fifth aspect, wherein the control unit performs first determination based on the detected information obtained from the refrigerant gas sensor and the oxygen gas sensor. The control unit performs second determination based on the detected information obtained from the refrigerant gas sensor, the oxygen gas sensor, and the air temperature sensor. The control unit provides the notification or changes or stops the operation in a different way in accordance with a result of the first determination and a result of the second determination.

In this refrigeration apparatus, the control unit performs two stages of determination, namely, first determination based on the detected information obtained from the refrigerant gas sensor and the oxygen gas sensor, and second determination based on the detected information obtained from the refrigerant gas sensor, the oxygen gas sensor, and the air temperature sensor, and provides the notification or changes or stops the operation in a different way in accordance with each stage. Accordingly, it is possible to provide a notification or change or stop the operation in a different way in accordance with the level of risk about the ignition possibility.

The notification provided in a different way includes, for example, but not limited to, a notification provided by outputting a sound with a higher volume for the second stage than for the first stage, and a notification provided by emitting light from a lamp or blinking the lamp with a larger amount of emission of light or a higher blinking speed for the second stage than for the first stage.

The change in the operation or stop of the operation includes, for example, but not limited to, continuing the operation in an operating state in which the amount of leak is reduced for the first stage, whereas completely stopping the operation for the second stage.

A refrigeration apparatus according to a seventh aspect is the refrigeration apparatus according to the fourth aspect, further including an air humidity sensor. The air humidity sensor detects an air humidity in the target space. The control unit provides a notification indicating that an ignition possibility has occurred, or changes an operation of the refrigeration cycle in the refrigerant circuit or stops the operation of the refrigeration cycle in the refrigerant circuit, on the basis of detected information obtained from the refrigerant gas sensor, the oxygen gas sensor, and the air humidity sensor.

In this refrigeration apparatus, when providing a notification indicating that an ignition possibility has occurred, or changing the operation of the refrigeration cycle in the refrigerant circuit or stopping the operation of the refrigeration cycle in the refrigerant circuit, the control unit performs determination on the basis of detected information obtained not only from the refrigerant gas sensor and the oxygen gas sensor but also from the air humidity sensor. Accordingly, the control unit can perform determination by taking into account the effect of the air humidity in the target space on the ignition possibility (such as taking into account that the higher the air humidity is, the higher the ignition possibility becomes).

A refrigeration apparatus according to an eighth aspect is the refrigeration apparatus according to the seventh aspect, wherein the control unit performs first determination based on the detected information obtained from the refrigerant gas sensor and the oxygen gas sensor. The control unit performs second determination based on the detected information obtained from the refrigerant gas sensor, the oxygen gas sensor, and the air humidity sensor. The control unit provides the notification or changes or stops the operation in a different way in accordance with a result of the first determination and a result of the second determination.

In this refrigeration apparatus, the control unit performs two stages of determination, namely, first determination based on the detected information obtained from the refrigerant gas sensor and the oxygen gas sensor, and second determination based on the detected information obtained from the refrigerant gas sensor, the oxygen gas sensor, and the air humidity sensor, and provides the notification or changes or stops the operation in a different way in accordance with each stage. Accordingly, it is possible to provide a notification or change or stop the operation in a different way in accordance with the level of risk about the ignition possibility.

The notification provided in a different way includes, for example, but not limited to, a notification provided by outputting a sound with a higher volume for the second stage than for the first stage, and a notification provided by emitting light from a lamp or blinking the lamp with a larger amount of emission of light or a higher blinking speed for the second stage than for the first stage.

The change in the operation or stop of the operation includes, for example, but not limited to, continuing the operation in an operating state in which the amount of leak is reduced for the first stage, whereas completely stopping the operation for the second stage.

A refrigeration apparatus according to a ninth aspect is the refrigeration apparatus according to the fourth aspect, further including a fan. The fan generates an air flow in the target space. The control unit causes the fan to forcibly blow air on the basis of the detected information obtained from the refrigerant gas sensor and the oxygen gas sensor.

In this refrigeration apparatus, even if the ignition possibility is increased, the fan is caused to forcibly blow air, thereby allowing the leaking refrigerant to spread out and enabling a reduction in the ignition possibility.

A refrigeration apparatus according to a tenth aspect is the refrigeration apparatus according to the fourth aspect, further including a human detecting sensor. The human detecting sensor detects a moving object in the target space. The control unit provides a notification indicating that an ignition possibility has occurred, or changes an operation of the refrigeration cycle in the refrigerant circuit or stops the operation of the refrigeration cycle in the refrigerant circuit, on the basis of detected information obtained from the refrigerant gas sensor, the oxygen gas sensor, and the human detecting sensor.

The moving object includes, for example, but not limited to, an animal and a person.

The human detecting sensor includes, for example, but not limited to, an infrared sensor, an ultrasonic sensor, a visible light sensor, and a camera.

In this refrigeration apparatus, when providing a notification indicating that an ignition possibility has occurred, or changing the operation of the refrigeration cycle in the refrigerant circuit or stopping the operation of the refrigeration cycle in the refrigerant circuit, the control unit performs determination on the basis of detected information obtained not only from the refrigerant gas sensor and the oxygen gas sensor but also from the human detecting sensor. Accordingly, the control unit can perform determination by taking into account the detection content of the human detecting sensor for a moving object in the target space. Thus, for example, when no moving object is present in the target space, no notification can be provided, or a notification, when provided, can be provided by, for example, using a sound with a lower volume than in the case where a moving object is present in the target space. In addition, it is possible to take countermeasures such as continuing the operation when no moving object is present in the target space, and stopping the operation when a moving object is present in the target space.

A refrigeration apparatus according to an eleventh aspect is the refrigeration apparatus according to the fourth aspect, further including a refrigerant pressure sensor. The refrigerant pressure sensor detects a pressure of the refrigerant in the refrigerant circuit. The control unit provides a notification indicating that an ignition possibility has occurred, or changes an operation of the refrigeration cycle in the refrigerant circuit or stops the operation of the refrigeration cycle in the refrigerant circuit, on the basis of detected information obtained from the refrigerant gas sensor, the oxygen gas sensor, and the refrigerant pressure sensor.

In this refrigeration apparatus, when providing a notification indicating that an ignition possibility has occurred, or changing the operation of the refrigeration cycle in the refrigerant circuit or stopping the operation of the refrigeration cycle in the refrigerant circuit, the control unit performs determination on the basis of detected information obtained not only from the refrigerant gas sensor and the oxygen gas sensor but also from the refrigerant pressure sensor. Accordingly, it is possible to enhance the reliability with which the control unit determines the ignition possibility.

For example, when the pressure detected by the refrigerant pressure sensor does not satisfy a predetermined pressure condition and is less than the predetermined pressure condition, it can be determined that a leak is likely to have occurred. It is therefore possible to enhance the reliability of performing determination for providing a notification, or changing or stopping the operation.

A refrigeration apparatus according to a twelfth aspect is the refrigeration apparatus according to the fourth aspect, further including an ultrasonic sensor. The ultrasonic sensor detects, while outputting an ultrasound wave to the target space, a reflected wave of the ultrasound wave from the target space. The control unit provides a notification indicating that an ignition possibility has occurred, or changes an operation of the refrigeration cycle in the refrigerant circuit or stops the operation of the refrigeration cycle in the refrigerant circuit, on the basis of detected information obtained from the refrigerant gas sensor, the oxygen gas sensor, and the ultrasonic sensor.

In this refrigeration apparatus, when providing a notification indicating that an ignition possibility has occurred, or changing the operation of the refrigeration cycle in the refrigerant circuit or stopping the operation of the refrigeration cycle in the refrigerant circuit, the control unit performs determination on the basis of detected information obtained not only from the refrigerant gas sensor and the oxygen gas sensor but also from the ultrasonic sensor. Accordingly, it is possible to further enhance the reliability with which the control unit determines the ignition possibility.

For example, when the reflected wave detected by the ultrasonic sensor satisfies a predetermined sound wave leak condition, it can be determined that a leak is likely to have occurred. It is therefore possible to enhance the reliability of performing determination for providing a notification, or changing or stopping the operation.

DESCRIPTION OF EMBODIMENTS

The following describes an air conditioner 100, which is a refrigeration apparatus according to an embodiment, with reference to the drawings. It should be noted that the following embodiment is a specific example and is not intended to limit the scope of the disclosure, but can be modified, as appropriate, without departing from the scope of the disclosure.

(1) Air Conditioner 100

Figure 1:
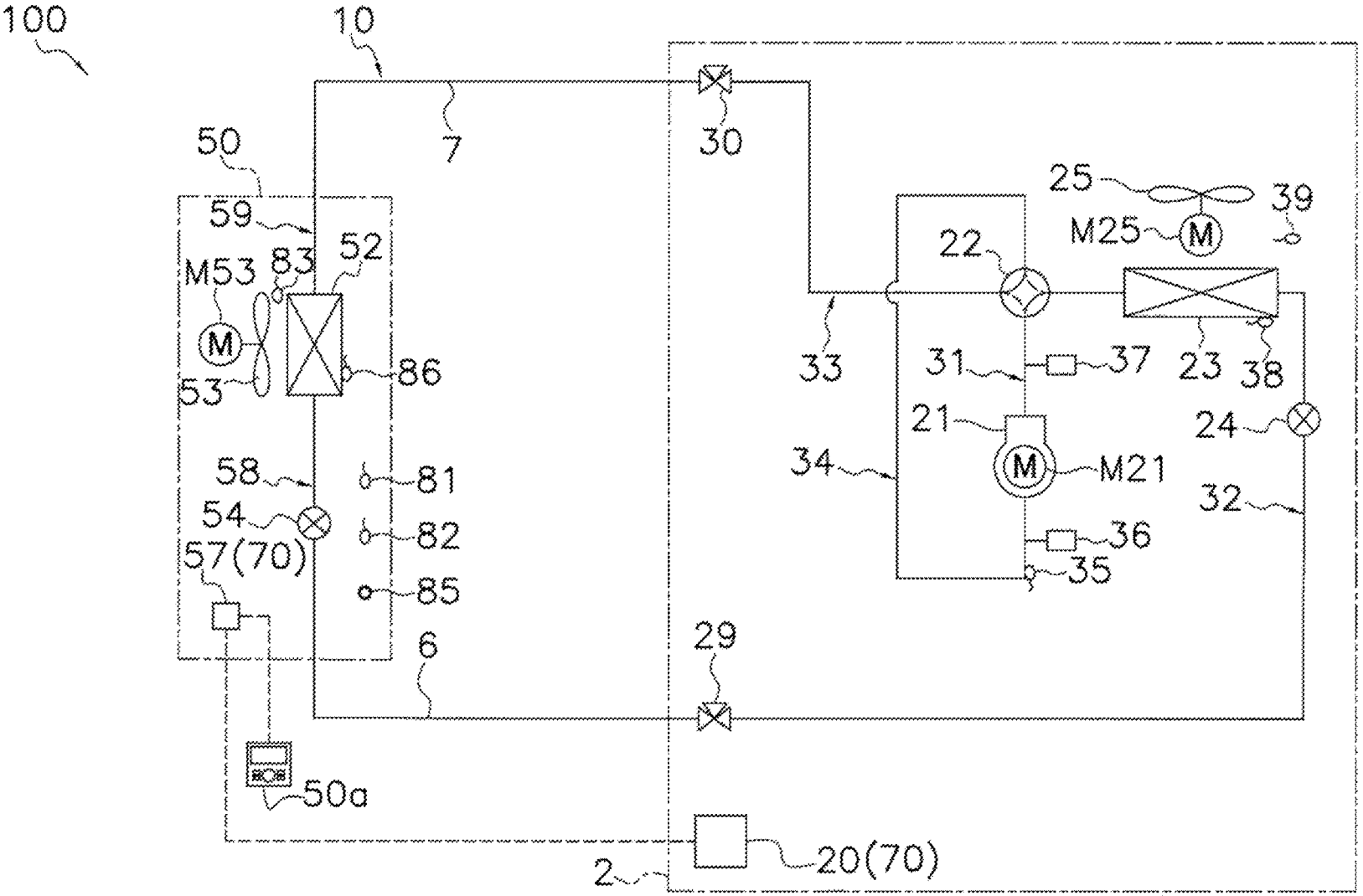
FIG. 1 is an overall configuration diagram of an air conditioner according to an embodiment.

FIG. 1 is a schematic configuration diagram of the air conditioner 100 according to an embodiment. The air conditioner 100 is an apparatus that performs air conditioning of a target space by performing a vapor-compression refrigeration cycle.

The air conditioner 100 mainly includes an outdoor unit 2, an indoor unit 50, a liquid-refrigerant connection pipe 6 and a gas-refrigerant connection pipe 7 that connect the outdoor unit 2 and the indoor unit 50, a plurality of remote controls 50*a*, each of which serves as an input device and an output device, and a controller 70 that controls the operation of the air conditioner 100.

In the air conditioner 100, a refrigeration cycle is performed such that refrigerant charged in a refrigerant circuit 10 is compressed, cooled or condensed, decompressed, heated or evaporated, and then compressed again. In this embodiment, the refrigerant circuit 10 is filled with R32 as a refrigerant for a vapor-compression refrigeration cycle.

(1-1) Outdoor Unit 2

The outdoor unit 2 is connected to the indoor unit 50 through the liquid-refrigerant connection pipe 6 and the gas-refrigerant connection pipe 7 and forms a portion of the refrigerant circuit 10. The outdoor unit 2 mainly includes a compressor 21, a four-way switching valve 22, an outdoor heat exchanger 23, an outdoor expansion valve 24, an outdoor fan 25, a liquid-side shutoff valve 29, and a gas-side shutoff valve 30.

The outdoor unit 2 further includes pipes constituting the refrigerant circuit 10, namely, a discharge pipe 31, a suction pipe 34, an outdoor gas-side pipe 33, and an outdoor liquid-side pipe 32. The discharge pipe 31 connects the discharge side of the compressor 21 and a first connection port of the four-way switching valve 22. The suction pipe 34 connects the suction side of the compressor 21 and a second connection port of the four-way switching valve 22. The outdoor gas-side pipe 33 connects a third connection port of the four-way switching valve 22 and the gas-side shutoff valve 30. The outdoor liquid-side pipe 32 extends from a fourth connection port of the four-way switching valve 22 to the liquid-side shutoff valve 29 through the outdoor heat exchanger 23 and the outdoor expansion valve 24.

The compressor 21 is a device that compresses a low-pressure refrigerant in the refrigeration cycle to a high-pressure refrigerant. The compressor 21 is implemented here as a hermetically sealed compressor in which a positive displacement compression element (not illustrated), such as a rotary or scroll compression element, is driven to rotate by a compressor motor M21. The compressor motor M21 is used to change volume and has an operating frequency that can be controlled by an inverter.

The connection state of the four-way switching valve 22 can be switched to switch the four-way switching valve 22 between a cooling-operation connection state in which the suction side of the compressor 21 and the gas-side shutoff valve 30 are connected while the discharge side of the compressor 21 and the outdoor heat exchanger 23 are connected and a heating-operation connection state in which the suction side of the compressor 21 and the outdoor heat exchanger 23 are connected while the discharge side of the compressor 21 and the gas-side shutoff valve 30 are connected.

The outdoor heat exchanger 23 is a heat exchanger that functions as a radiator for a high-pressure refrigerant in the refrigeration cycle during a cooling operation and that functions as an evaporator for a low-pressure refrigerant in the refrigeration cycle during a heating operation.

The outdoor fan 25 generates an air flow for sucking outdoor air into the outdoor unit 2, allowing the air to exchange heat with the refrigerant in the outdoor heat exchanger 23, and then discharging the air to the outside. The outdoor fan 25 is driven to rotate by an outdoor fan motor M25.

The outdoor expansion valve 24 is an electric expansion valve whose valve opening degree is controllable, and is disposed midway in the outdoor liquid-side pipe 32 between the outdoor heat exchanger 23 and the liquid-side shutoff valve 29.

The liquid-side shutoff valve 29 is a manual valve that is arranged in a connecting portion between the outdoor liquid-side pipe 32 and the liquid-refrigerant connection pipe 6.

The gas-side shutoff valve 30 is a manual valve that is arranged in a connecting portion between the outdoor gas-side pipe 33 and the gas-refrigerant connection pipe 7.

The outdoor unit 2 has various sensors arranged therein.

Specifically, the outdoor unit 2 has arranged, near the compressor 21, a suction temperature sensor 35 to detect a suction temperature that is the temperature of refrigerant on the suction side of the compressor 21, a suction pressure sensor 36 to detect a suction pressure that is the pressure of refrigerant on the suction side of the compressor 21, and a discharge pressure sensor 37 to detect a discharge pressure that is the pressure of refrigerant on the discharge side of the compressor 21.

The outdoor heat exchanger 23 is also provided with an outdoor heat-exchange temperature sensor 38 to detect the temperature of refrigerant flowing through the outdoor heat exchanger 23.

Further, an outside air temperature sensor 39 is arranged near the outdoor heat exchanger 23 or the outdoor fan 25 to detect the temperature of outdoor air that is sucked into the outdoor unit 2.

The outdoor unit 2 includes an outdoor-unit control unit 20 that controls the operation of components of the outdoor unit 2. The outdoor-unit control unit 20 has a microcomputer including a CPU, a memory, and so on. The outdoor-unit control unit 20 is connected to an indoor-unit control unit 57 of indoor unit 50 via a communication line, and transmits and receives control signals and the like. Further, the outdoor-unit control unit 20 is electrically connected to the suction temperature sensor 35, the suction pressure sensor 36, the discharge pressure sensor 37, the outdoor heat-exchange temperature sensor 38, and the outside air temperature sensor 39, and receives a signal from each of the sensors.

(1-2) Indoor Unit 50

The indoor unit 50 is mounted on the wall surface, the ceiling, or the like of a room that is the target space. The indoor unit 50 is connected to the outdoor unit 2 through the liquid-refrigerant connection pipe 6 and the gas-refrigerant connection pipe 7 and forms a portion of the refrigerant circuit 10.

The indoor unit 50 includes an indoor expansion valve 54, an indoor heat exchanger 52, and an indoor fan 53.

The indoor unit 50 further includes an indoor liquid refrigerant pipe 58 that connects the liquid-side end of the indoor heat exchanger 52 and the liquid-refrigerant connection pipe 6, and an indoor gas refrigerant pipe 59 that connects the gas-side end of the indoor heat exchanger 52 and the gas-refrigerant connection pipe 7.

The indoor expansion valve 54 is an electric expansion valve whose valve opening degree is controllable, and is disposed midway in the indoor liquid refrigerant pipe 58.

The indoor heat exchanger 52 is a heat exchanger that functions as an evaporator for a low-pressure refrigerant in the refrigeration cycle during a cooling operation and that functions as a radiator for a high-pressure refrigerant in the refrigeration cycle during a heating operation.

The indoor fan 53 generates an air flow for sucking indoor air into the indoor unit 50, allowing the air to exchange heat with the refrigerant in the indoor heat exchanger 52, and then discharging the air to the outside. The indoor fan 53 is driven to rotate by an indoor fan motor M53.

The indoor unit 50 has various sensors arranged therein. Specifically, the indoor unit 50 has arranged therein a refrigerant gas sensor 81 (e.g., a sensor that electrically reacts differently in accordance with the refrigerant gas concentration) to detect the concentration of the refrigerant gas charged in the refrigerant circuit 10, an oxygen gas sensor 82 to detect the oxygen concentration, an air temperature sensor 83 to detect the air temperature in a space where the indoor unit 50 is installed, an infrared sensor 85 to detect a moving object in the space where the indoor unit 50 is installed, and an indoor heat-exchange temperature sensor 86 to detect the temperature of refrigerant flowing through the indoor heat exchanger 52.

Further, the indoor unit 50 includes the indoor-unit control unit 57, which controls the operation of components of the indoor unit 50. The indoor-unit control unit 57 has a microcomputer including a CPU, a memory, and so on. The indoor-unit control unit 57 is connected to the outdoor-unit control unit 20 via a communication line, and transmits and receives control signals and the like.

The indoor-unit control unit 57 is electrically connected to the refrigerant gas sensor 81, the oxygen gas sensor 82, the air temperature sensor 83, the infrared sensor 85, and the indoor heat-exchange temperature sensor 86, and receives a signal from each of the sensors.

(1-3) Remote Control 50*a*

The remote control 50*a* is an input device used by the user of the indoor unit 50 to input various instructions to switch the operating state of the air conditioner 100. The remote control 50*a* also functions as an output device for informing the user of the operating state of the air conditioner 100 or providing a predetermined notification. The remote control 50*a* and the indoor-unit control unit 57 are connected via a communication line and transmit and receive signals to and from each other. The remote control 50*a* has a built-in speaker.

(2) Details of Controller 70

In the air conditioner 100, the outdoor-unit control unit 20 and the indoor-unit control unit 57, which are connected via a communication line, form the controller 70 that controls the operation of the air conditioner 100.

Figure 2:
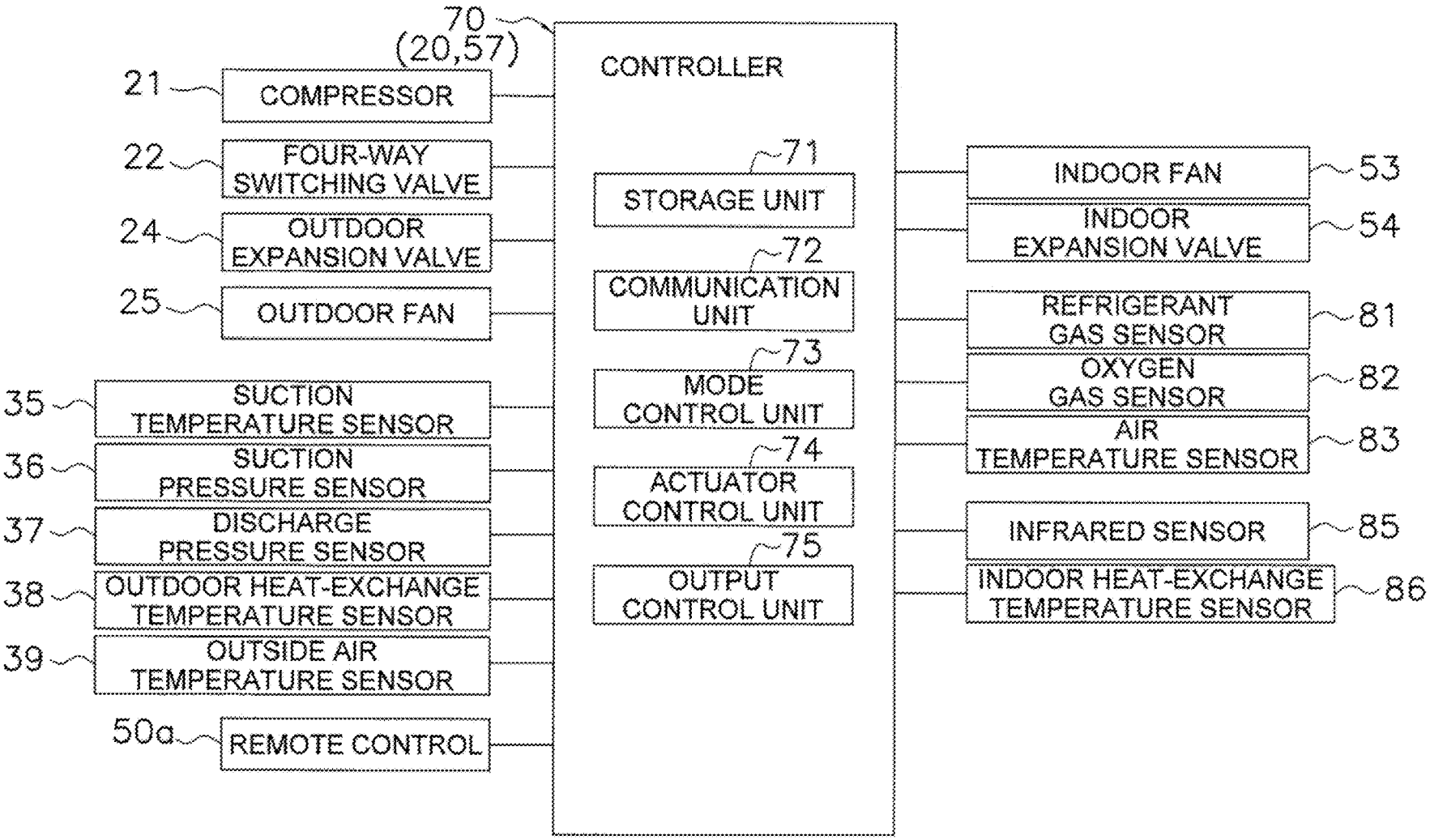
FIG. 2 is a block diagram schematically illustrating the general configuration of a controller and components connected to the controller.

FIG. 2 is a block diagram schematically illustrating the general configuration of the controller 70 and components connected to the controller 70.

The controller 70 has a plurality of control modes, and controls the operation of the air conditioner 100 in accordance with the control modes. For example, the controller 70 has, as the control modes, a normal operation mode, which is executed under normal conditions, and a refrigerant leak control mode, which is executed when a refrigerant leak occurs.

The controller 70 is electrically connected to the actuators included in the outdoor unit 2 (specifically, the compressor 21 (the compressor motor M21), the outdoor expansion valve 24, and the outdoor fan 25 (the outdoor fan motor M25)) and the various sensors included in the outdoor unit 2 (such as the suction temperature sensor 35, the suction pressure sensor 36, the discharge pressure sensor 37, the outdoor heat-exchange temperature sensor 38, and the outside air temperature sensor 39). The controller 70 is also electrically connected to the actuators included in the indoor unit 50 (specifically, the indoor fan 53 (the indoor fan motor M53) and the indoor expansion valve 54). Further, the controller 70 is electrically connected to the refrigerant gas sensor 81, the oxygen gas sensor 82, the air temperature sensor 83, the infrared sensor 85, the indoor heat-exchange temperature sensor 86, and the remote control 50*a*.

The controller 70 mainly includes a storage unit 71, a communication unit 72, a mode control unit 73, an actuator control unit 74, and an output control unit 75. These components in the controller 70 are implemented by the integrated functioning of the components included in the outdoor-unit control unit 20 and/or the indoor-unit control unit 57.

(2-1) Storage Unit 71

The storage unit 71 is constituted by, for example, a ROM, a RAM, a flash memory, and so on and includes a volatile storage area and a non-volatile storage area. The storage unit 71 stores a control program that defines processes performed by the components of the controller 70. The storage unit 71 further stores predetermined information (such as values detected by sensors and commands input to the remote control 50*a*) in predetermined storage areas, as appropriate, by using the components of the controller 70.

(2-2) Communication Unit 72

The communication unit 72 is a function unit that serves as a communication interface for transmitting and receiving signals to and from devices connected to the controller 70. The communication unit 72 transmits a predetermined signal to a designated actuator upon receipt of a request from the actuator control unit 74. Further, upon receipt of a signal output from each of the sensors 35 to 39, 81 to 83, 85, and 86 and the remote control 50*a*, the communication unit 72 stores the signal in a predetermined storage area of the storage unit 71.

(2-3) Mode Control Unit 73

The mode control unit 73 is a function unit that performs processing such as switching between the control modes. When a predetermined refrigerant leak condition is not satisfied for indoor unit 50, the mode control unit 73 sets the control mode to the normal operation mode.

On the other hand, when the predetermined refrigerant leak condition is satisfied for the indoor unit 50, the mode control unit 73 switches the control mode to the refrigerant leak control mode.

(2-4) Actuator Control Unit 74

The actuator control unit 74 controls the operation of the actuators (such as the compressor 21) included in the air conditioner 100 in accordance with the control program.

For example, in the normal operation mode, the actuator control unit 74 controls the number of revolutions of the compressor 21, the numbers of revolutions of the outdoor fan 25 and the indoor fan 53, the valve opening degree of the outdoor expansion valve 24, the valve opening degree of the indoor expansion valve 54, and the like in real time in accordance with a set temperature, values detected by various sensors, and so on.

In the refrigerant leak control mode, the actuator control unit 74 controls the operation of the actuators so that a predetermined operation can be performed. Specifically, when refrigerant leaks, the actuator control unit 74 interrupts the supply of refrigerant to the indoor unit 50.

(2-5) Output Control Unit 75

The output control unit 75 is a function unit that controls the operation of the remote control 50*a*, which serves as a display device.

The output control unit 75 causes the remote control 50*a* to output predetermined information so as to present information related to the operating state or conditions to an administrator.

For example, during the execution of the cooling operation mode in the normal operation mode, the output control unit 75 causes the remote control 50*a* to display various kinds of information such as a set temperature.

In the refrigerant leak control mode, the output control unit 75 causes a display of the remote control 50*a* to display information indicating the occurrence of a refrigerant leak. Further, the output control unit 75 provides an audible notification indicating the occurrence of a refrigerant leak by using the built-in speaker of the remote control 50*a*. The output control unit 75 further causes the remote control 50*a* to display information to promote notification to a service engineer.

(3) Normal Operating Mode

The following describes the normal operation mode.

The normal operation mode includes a cooling operation mode and a heating operation mode.

The controller 70 determines and performs the cooling operation mode or the heating operation mode in accordance with an instruction received from the remote control 50*a* or the like.

(3-1) Cooling Operation Mode

In the air conditioner 100, in the cooling operation mode, the connection state of the four-way switching valve 22 is set to a cooling-operation connection state in which the suction side of the compressor 21 and the gas-side shutoff valve 30 are connected while the discharge side of the compressor 21 and the outdoor heat exchanger 23 are connected. The refrigerant with which the refrigerant circuit 10 is filled is mainly circulated in the order of the compressor 21, the outdoor heat exchanger 23, the outdoor expansion valve 24, the indoor expansion valve 54, and the indoor heat exchanger 52.

More specifically, when the cooling operation mode is started, in the refrigerant circuit 10, the refrigerant is sucked into the compressor 21, compressed, and then discharged. A low pressure in the refrigeration cycle corresponds to a suction pressure detected by the suction pressure sensor 36, and a high pressure in the refrigeration cycle corresponds to a discharge pressure detected by the discharge pressure sensor 37.

In the compressor 21, capacity control is performed in accordance with cooling load required for the indoor unit 50. Specifically, a target value of the suction pressure is set in accordance with the cooling load required for the indoor unit 50, and the operating frequency of the compressor 21 is controlled such that the suction pressure becomes equal to the target value.

The gas refrigerant discharged from the compressor 21 travels through the discharge pipe 31 and the four-way switching valve 22, and flows into the gas-side end of the outdoor heat exchanger 23.

The gas refrigerant that has flowed into the gas-side end of the outdoor heat exchanger 23 releases heat and condenses into a liquid refrigerant in the outdoor heat exchanger 23 by exchanging heat with outdoor-side air supplied by the outdoor fan 25. The liquid refrigerant flows out of the liquid-side end of the outdoor heat exchanger 23.

The liquid refrigerant that has flowed out of the liquid-side end of the outdoor heat exchanger 23 travels through the outdoor liquid-side pipe 32, the outdoor expansion valve 24, the liquid-side shutoff valve 29, and the liquid-refrigerant connection pipe 6, and flows into the indoor unit 50. In the cooling operation mode, the outdoor expansion valve 24 is controlled to be fully opened.

The refrigerant that has flowed into the indoor unit 50 travels through a portion of the indoor liquid refrigerant pipe 58, and flows into the indoor expansion valve 54. The refrigerant that has flowed into the indoor expansion valve 54 is decompressed by the indoor expansion valve 54 until the refrigerant becomes a low-pressure refrigerant in the refrigeration cycle, and then flows into the liquid-side end of the indoor heat exchanger 52. In the cooling operation mode, the valve opening degree of the indoor expansion valve 54 is controlled such that the degree of superheating of refrigerant sucked into the compressor 21 becomes equal to a predetermined degree of superheating. The degree of superheating of refrigerant sucked into the compressor 21 is calculated by the controller 70 by using the temperature detected by the suction temperature sensor 35 and the pressure detected by the suction pressure sensor 36. The refrigerant that has flowed into the liquid-side end of the indoor heat exchanger 52 evaporates into a gas refrigerant in the indoor heat exchanger 52 by exchanging heat with indoor air supplied by the indoor fan 53. The gas refrigerant flows out of the gas-side end of the indoor heat exchanger 52. The gas refrigerant that has flowed out of the gas-side end of the indoor heat exchanger 52 flows to the gas-refrigerant connection pipe 7 through the indoor gas refrigerant pipe 59.

In this way, the refrigerant flowing through the gas-refrigerant connection pipe 7 travels through the gas-side shutoff valve 30, the outdoor gas-side pipe 33, the four-way switching valve 22, and the suction pipe 34, and is again sucked into the compressor 21.

(3-2) Heating Operation Mode

In the air conditioner 100, in the heating operation mode, the connection state of the four-way switching valve 22 is set to a heating-operation connection state in which the suction side of the compressor 21 and the outdoor heat exchanger 23 are connected while the discharge side of the compressor 21 and the gas-side shutoff valve 30 are connected. The refrigerant with which the refrigerant circuit 10 is filled is mainly circulated in the order of the compressor 21, the indoor heat exchanger 52, the indoor expansion valve 54, the outdoor expansion valve 24, and the outdoor heat exchanger 23.

More specifically, when the heating operation mode is started, in the refrigerant circuit 10, the refrigerant is sucked into the compressor 21, compressed, and then discharged. A low pressure in the refrigeration cycle corresponds to a suction pressure detected by the suction pressure sensor 36, and a high pressure in the refrigeration cycle corresponds to a discharge pressure detected by the discharge pressure sensor 37.

In the compressor 21, capacity control is performed in accordance with the heating load required for the indoor unit 50. Specifically, a target value of the discharge pressure is set in accordance with the heating load required for the indoor unit 50, and the operating frequency of the compressor 21 is controlled such that the discharge pressure becomes equal to the target value.

The gas refrigerant discharged from the compressor 21 flows through the discharge pipe 31, the four-way switching valve 22, the outdoor gas-side pipe 33, and the gas-refrigerant connection pipe 7, and then flows into the indoor unit 50 through the indoor gas refrigerant pipe 59.

The refrigerant that has flowed into the indoor unit 50 travels through the indoor gas refrigerant pipe 59, and flows into the gas-side end of the indoor heat exchanger 52. The refrigerant that has flowed into the gas-side end of the indoor heat exchanger 52 releases heat and condenses into a liquid refrigerant in the indoor heat exchanger 52 by exchanging heat with indoor air supplied by the indoor fan 53. The liquid refrigerant flows out of the liquid-side end of the indoor heat exchanger 52. The refrigerant that has flowed out of the liquid-side end of the indoor heat exchanger 52 flows to the liquid-refrigerant connection pipe 6 through the indoor liquid refrigerant pipe 58 and the indoor expansion valve 54. In the heating operation mode, the valve opening degree of the indoor expansion valve 54 is controlled to be fully opened.

In this way, the refrigerant flowing through the liquid-refrigerant connection pipe 6 flows into the outdoor expansion valve 24 through the liquid-side shutoff valve 29 and the outdoor liquid-side pipe 32.

The refrigerant that has flowed into the outdoor expansion valve 24 is decompressed until the refrigerant becomes a low-pressure refrigerant in the refrigeration cycle, and then flows into the liquid-side end of the outdoor heat exchanger 23. In the heating operation mode, the valve opening degree of the outdoor expansion valve 24 is controlled such that the degree of superheating of refrigerant sucked into the compressor 21 becomes equal to a predetermined degree of superheating.

The refrigerant that has flowed into the liquid-side end of the outdoor heat exchanger 23 evaporates into a gas refrigerant in the outdoor heat exchanger 23 by exchanging heat with outdoor air supplied by the outdoor fan 25. The gas refrigerant flows out of the gas-side end of the outdoor heat exchanger 23.

The refrigerant that has flowed out of the gas-side end of the outdoor heat exchanger 23 travels through the four-way switching valve 22 and the suction pipe 34, and is again sucked into the compressor 21.

(4) Refrigerant Leak Control Mode

Figure 3:
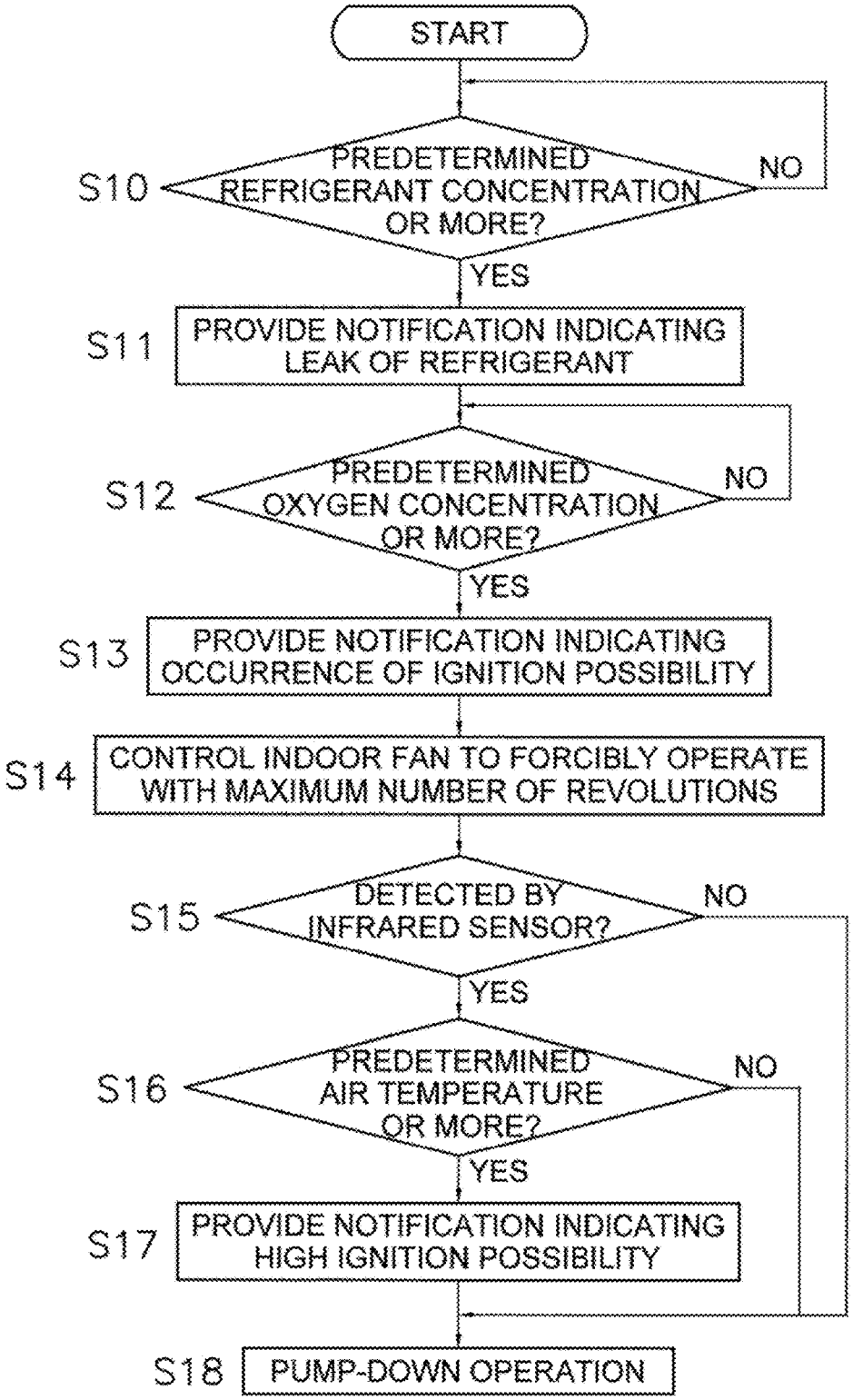
FIG. 3 is a flowchart illustrating an example process flow of the controller in a refrigerant leak control mode.

The following describes an example process flow for the refrigerant leak control mode, which is executed by the controller 70 when a refrigerant leak occurs in the normal operation mode with reference to a flowchart illustrated in FIG. 3.

In step S10, when the normal operation mode of the cooling operation mode or heating operation mode is being executed, the controller 70 determines whether the refrigerant concentration detected by the refrigerant gas sensor 81 is greater than or equal to a predetermined refrigerant concentration. The predetermined refrigerant concentration is determined in advance in accordance with the type of the refrigerant charged in the refrigerant circuit 10 (in this embodiment, R32) and is stored in the storage unit 71. If the controller 70 determines that the refrigerant concentration detected by the refrigerant gas sensor 81 is greater than or equal to the predetermined refrigerant concentration, the process proceeds to step S11. On the other hand, if the refrigerant concentration detected by the refrigerant gas sensor 81 is less than the predetermined refrigerant concentration, the normal operation mode remains continuously active and step S10 is repeatedly performed.

In step S11, the controller 70 starts the refrigerant leak control mode and causes the output control unit 75 to display, on the display of the remote control 50*a*, information indicating a leak of refrigerant as text information. Further, the controller 70 causes the output control unit 75 to provide a notification indicating the leak of refrigerant as audio information from the speaker of the remote control 50*a*.

In step S12, the controller 70 determines whether the oxygen concentration detected by the oxygen gas sensor 82 is greater than or equal to a predetermined oxygen concentration. The predetermined oxygen concentration is determined in advance in accordance with the type of the refrigerant charged in the refrigerant circuit 10 (in this embodiment, R32) and is stored in the storage unit 71. If the controller 70 determines that the oxygen concentration detected by the oxygen gas sensor 82 is greater than or equal to the predetermined oxygen concentration, the process proceeds to step S13. On the other hand, if the oxygen concentration detected by the oxygen gas sensor 82 is less than the predetermined oxygen concentration, step S12 is repeatedly performed.

In step S13, the controller 70 causes the output control unit 75 to display, on the display of the remote control 50*a*, information indicating that an ignition possibility has occurred due to the leak of refrigerant as text information. Further, the controller 70 causes the output control unit 75 to provide a notification indicating that an ignition possibility has occurred due to the leak of refrigerant as audio information from the speaker of the remote control 50*a* (notification with a greater sound than that in step S11).

In step S14, the controller 70 controls the indoor fan 53 to forcibly operate with a maximum number of revolutions. This allows the refrigerant that has leaked to be stirred and can suppress a local increase in concentration.

In step S15, the controller 70 determines whether the infrared sensor 85 has detected a moving object such as a person or an animal in the room. If the controller 70 determines that the infrared sensor 85 has detected an object, the process proceeds to step S16. On the other hand, if it is determined that no object is detected by the infrared sensor 85, the process proceeds to step S18.

In step S16, the controller 70 determines whether the temperature of air in the room, which is detected by the air temperature sensor 83, is greater than or equal to a predetermined air temperature. The predetermined air temperature is determined in advance in accordance with the type of the refrigerant charged in the refrigerant circuit 10 (in this embodiment, R32) and is stored in the storage unit 71. In most refrigerants, including R32, the ignition possibility increases as the air temperature increases. If the controller 70 determines that the temperature of air in the room, which is detected by the air temperature sensor 83, is greater than or equal to the predetermined air temperature, the process proceeds to step S17. On the other hand, if it is determined that the temperature is not greater than or equal to the predetermined air temperature, the process proceeds to step S18.

In step S17, the controller 70 causes the output control unit 75 to display, on the display of the remote control 50*a*, information indicating that the ignition possibility becomes high due to the leak of refrigerant as text information. Further, the controller 70 causes the output control unit 75 to provide a notification indicating that the ignition possibility becomes high due to the leak of refrigerant as audio information from the speaker of the remote control 50*a* (notification with a greater sound than that in step S13).

In step S18, the controller 70 performs a pump-down operation. In the pump-down operation, while the connection state of the four-way switching valve 22 is set to the connection state in the cooling operation mode, the outdoor expansion valve 24 is closed, the compressor 21 is driven, the outdoor fan 25 is driven, and the outdoor heat exchanger 23 is caused to function as a condenser for refrigerant. Accordingly, within the refrigerant circuit 10, refrigerant present on the indoor unit 50 side is collected before the refrigerant reaches the outdoor expansion valve 24 from the discharge side of the compressor 21 of the outdoor unit 2 through the outdoor heat exchanger 23, thereby suppressing a further leak of refrigerant from a leak portion of the indoor unit 50. In a state where the cooling operation mode is executed during a leak of refrigerant, the pump-down operation is performed, with the connection state of the four-way switching valve 22 remaining unchanged. In a state where the heating operation mode is executed during a leak of refrigerant, in contrast, the pump-down operation is performed after the connection state of the four-way switching valve 22 is switched to that in the cooling operation mode. The pump-down operation is finished when the pressure detected by the suction pressure sensor 36 becomes less than or equal to a predetermined termination pressure. The driving of the compressor 21 is stopped, and the operation of the air conditioner 100 is stopped.

(5) Features of Air Conditioner 100

(5-1)

In the air conditioner 100 according to this embodiment, if refrigerant that can be ignited leaks from the refrigerant circuit 10, in addition to the refrigerant gas sensor 81 merely detecting the leaking refrigerant and providing a notification indicating that refrigerant has leaked, the oxygen gas sensor 82 is used to detect an oxygen gas. When it is determined that the refrigerant concentration of the refrigerant that has leaked is greater than or equal to a predetermined refrigerant concentration and that the oxygen gas concentration is greater than or equal to a predetermined oxygen concentration, a notification is provided indicating that an ignition possibility has occurred.

Accordingly, the concentrations of both a refrigerant gas and an oxygen gas are detected. This enables more accurate determination of an ignition possibility than the case where only a refrigerant gas that has leaked is detected.

For example, when the indoor unit 50 of the air conditioner 100 is used in a low-oxygen-concentration environment such as in a specific factory, a slight leak of refrigerant may not lead directly to the occurrence of an ignition possibility. In this case, even if refrigerant leaks, it is possible to determine that the ignition possibility is low.

Even when no ignition possibility has occurred, if refrigerant leaks and its concentration becomes greater than or equal to a predetermined refrigerant concentration, it is possible to notify the user or the like that a refrigerant leak has occurred.

(5-2)

In the air conditioner 100 according to this embodiment, if refrigerant has leaked in the indoor unit 50 and an ignition possibility has occurred, the pump-down operation is performed to collect the refrigerant in the outdoor unit 2. This can suppress a further leak of refrigerant from a leak portion of the indoor unit 50. This can also suppress a further increase of the ignition possibility.

(5-3)

In the air conditioner 100 according to this embodiment, in addition to the detection of the refrigerant concentration by the refrigerant gas sensor 81 and the detection of the oxygen concentration by the oxygen gas sensor 82, a moving object is also detected by using the infrared sensor 85. When the infrared sensor 85 detects the presence of a moving object in the room, it is determined whether the ignition possibility is high by using the air temperature sensor 83, and the moving object can be notified of a high ignition possibility. If no moving object is present in the target space, such as when the infrared sensor 85 detects no object, a notification by sound with a high volume is not provided. This can suppress the occurrence of a loud sound more than necessary.

In addition, the determination of whether the ignition possibility is high can be based on air temperature or air humidity at which ignition is likely to occur in accordance with the type of the refrigerant charged in the refrigerant circuit 10. Thus, whether the ignition possibility is high can be more accurately determined.

(5-4)

In the air conditioner 100 according to this embodiment, when it is determined that an ignition possibility has occurred, the indoor fan 53 is forcibly driven with a maximum number of revolutions. This can suppress the occurrence of a local increase in refrigerant concentration within the room, and ignition can be less likely to occur.

(6) Modifications

The embodiment described above can be modified as appropriate, as given in the following modifications. Each of the modifications may be used in combination with any other modification so long as consistency is maintained.

(6-1) Modification A

In the embodiment described above, a case has been described as an example in which the refrigerant charged in the refrigerant circuit 10 is R32.

The refrigerant to be charged in the refrigerant circuit 10 is not limited to this, and examples of the refrigerant other than R32 may include flammable refrigerants classified in Class A3 of ASHRAE 34 Refrigerant Safety Classification, low flammable refrigerants classified in Class A2 of ASHRAE 34 Refrigerant Safety Classification, and mildly flammable refrigerants classified in Class A2L of ASHRAE 34 Refrigerant Safety Classification. These refrigerants can also be ignited when leaking, and thus effects similar to those of the embodiment described above can be achieved.

Other examples of the refrigerant to be charged in the refrigerant circuit 10, other than R32, may include refrigerants with lower GWP than R32 (a natural refrigerant such as R717 and, R170, R1270, R290, R600, R600a, R152a, and a refrigerant mixture thereof). Even when such a refrigerant as having a low GWP value is used, a leak can be appropriately detected and a leak notification is provided. This ensures that necessary countermeasures against the leak can be taken.

(6-2) Modification B

In the embodiment described above, a case has been described as an example in which a notification indicating that refrigerant has leaked, a notification indicating that an ignition possibility has occurred, and a notification indicating that the ignition possibility is high are provided by displaying text information on the display of the remote control 50*a* and by using audio information from the speaker of the remote control 50*a*.

However, the type of notification is not limited to these. For example, when the remote control 50*a* is provided with a lamp, the lamp may be turned on or made to blink. When a notification is provided by using a lamp, the notification may be provided in a different way in accordance with the determined level of the ignition possibility such that the amount of emission of light is increased, the color of emitted light is changed, or the blinking speed is increased.

When the controller 70 is connected to an external remote monitoring device or the like, which is constituted by a computer, via the communication unit 72 so that they can communicate with each other over a communication network, the controller 70 may transmit to the external remote monitoring device or the like information indicating that refrigerant has leaked, an ignition possibility has occurred, and the ignition possibility is high. In this case, a service engineer who specializes in taking countermeasures against refrigerant leaks that are being monitored in the remote monitoring device can also be appropriately informed of the situation.

(6-3) Modification C

In the embodiment described above, a case has been described as an example in which in the refrigerant leak control mode, a pump-down operation is finally performed to stop the air conditioner 100.

However, the control of the air conditioner 100, which is performed after an ignition possibility has occurred, is not limited to this. For example, control may be performed to reduce the frequency of the compressor 21 after a leak. When an ignition possibility has occurred during the execution of the cooling operation mode, the indoor expansion valve 54 may be closed so as not to supply further refrigerant to the indoor heat exchanger 52.

For example, in a stage where an ignition possibility has only occurred, the operation of the air conditioner 100 may be continuously performed, with the driving of the compressor 21 reduced, and in a stage where the ignition possibility becomes high, a pump-down operation may be performed to stop the air conditioner 100. Alternatively, for example, in a stage where an ignition possibility has only occurred, the operation of the air conditioner 100 may be continuously performed, with the indoor fan 53 forcibly driven with a maximum number of revolutions, and in a stage where the ignition possibility becomes high, a pump-down operation may be performed to stop the air conditioner 100.

(6-4) Modification D

In the embodiment described above, a case has been described as an example in which the air temperature sensor 83 is included and, as illustrated in step S16, in the refrigerant leak control mode, a detection result of the air temperature sensor 83 is used to determine whether the ignition possibility is high.

Figure 4:
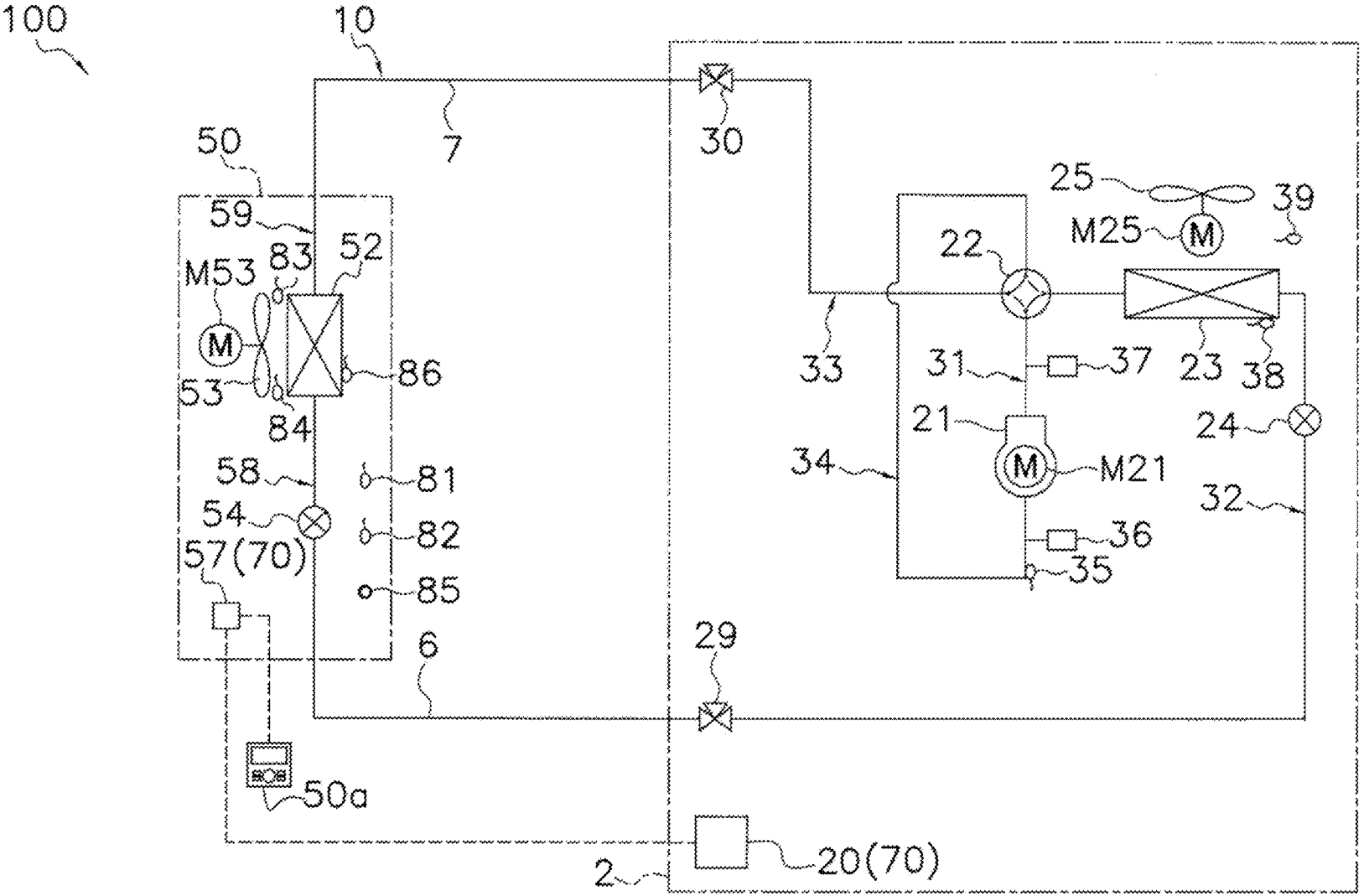
FIG. 4 is an overall configuration diagram of an air conditioner according to Modification D.
Figure 5:
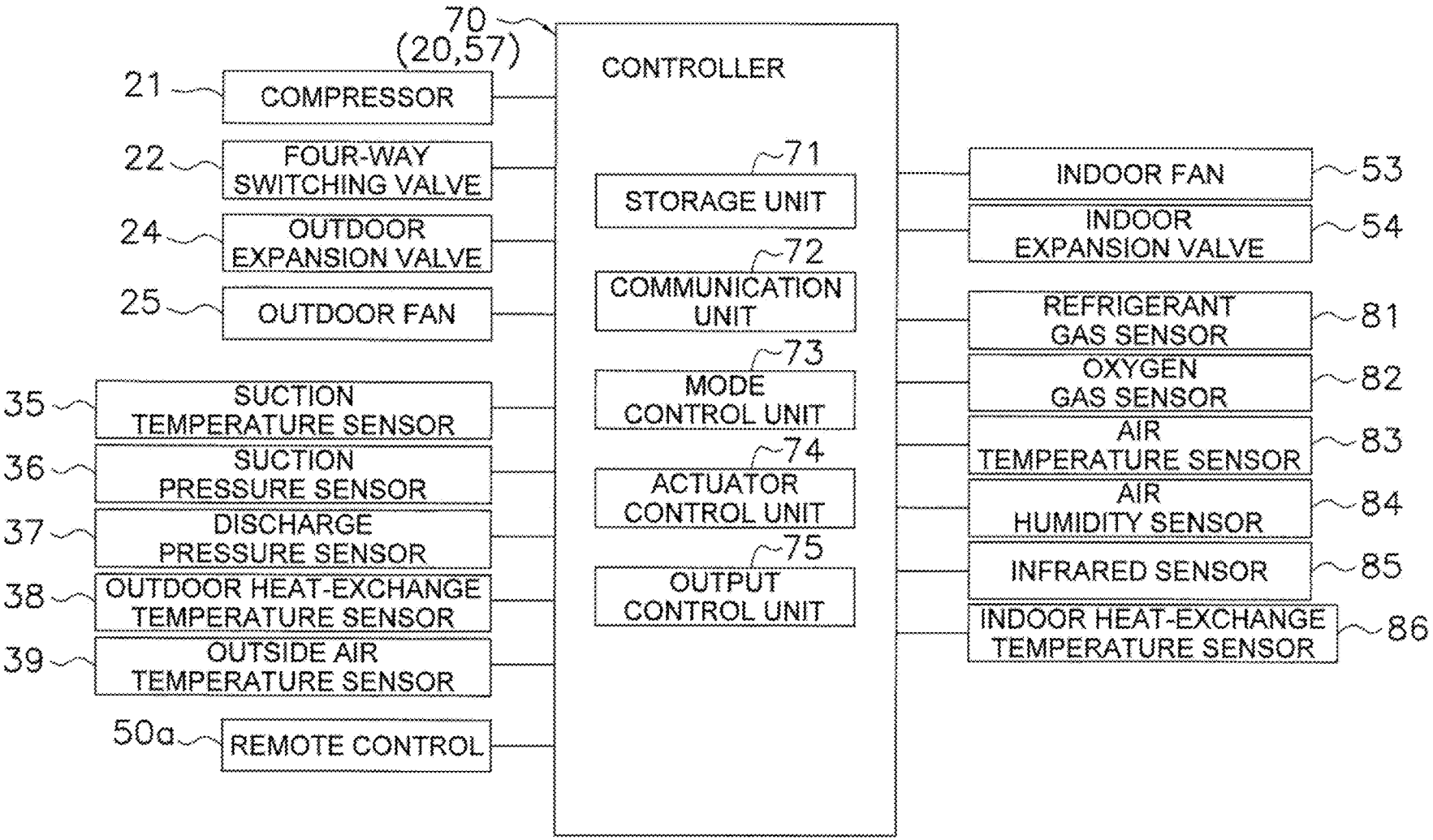
FIG. 5 is a block diagram schematically illustrating the general configuration of a controller according to Modification D and components connected to the controller.

Alternatively, for example, as illustrated in FIG. 4 and FIG. 5, an air conditioner 100*a* may be used that further includes an air humidity sensor 84 to detect the air humidity in the space where the indoor unit 50 is installed. The air humidity sensor 84 is also electrically connected to the indoor-unit control unit 57 so that a detection signal can be transmitted.

Figure 6:
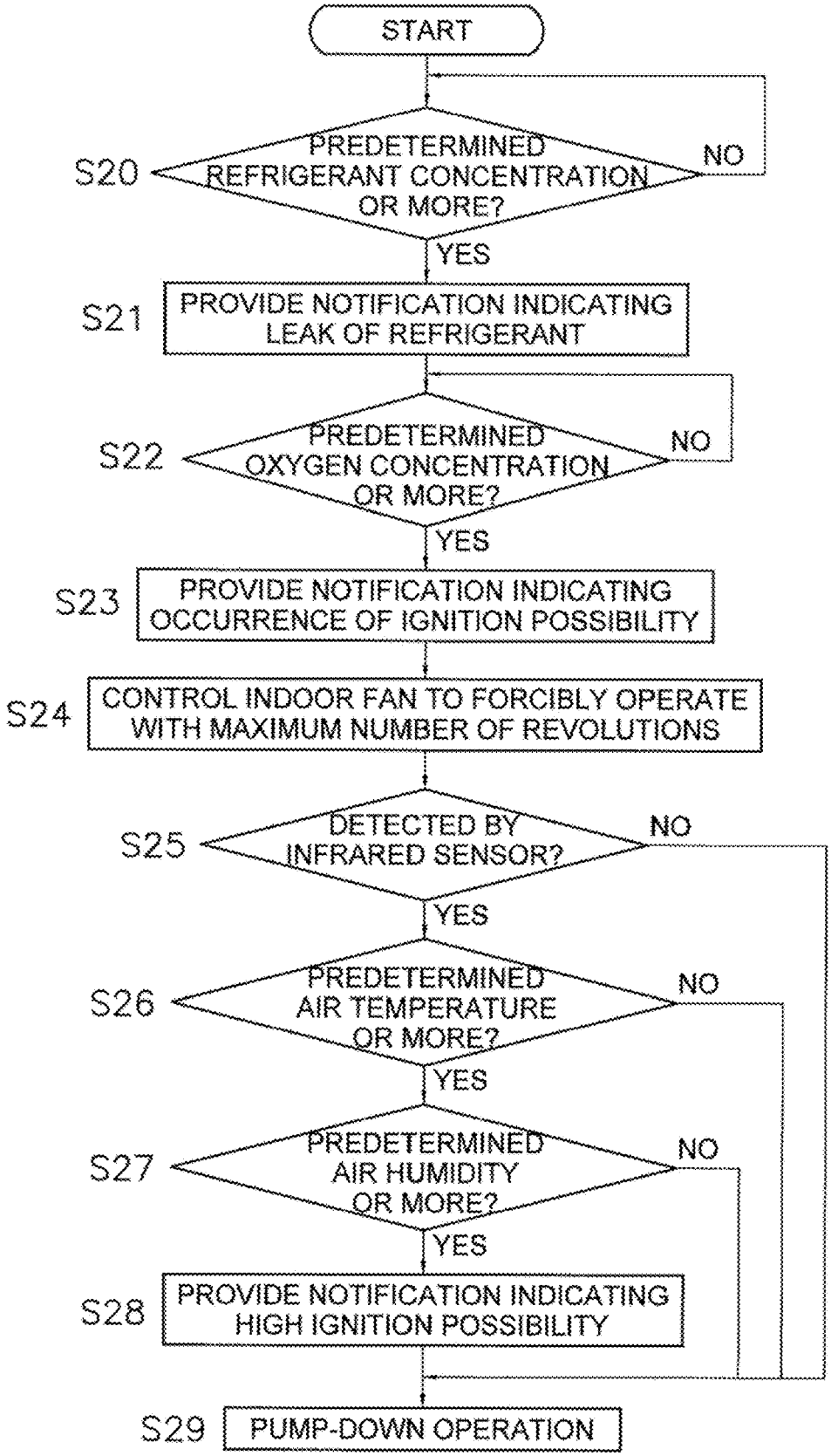
FIG. 6 is a flowchart illustrating an example process flow of the controller in the refrigerant leak control mode according to Modification D.

As illustrated in FIG. 6, the processing of steps S20 to S26, S28, and S29 is similar to that of steps S10 to S18 according to the embodiment described above, and the processing of step S27, described below, may be added after step S26.

In step S27, the controller 70 determines whether the humidity of indoor air detected by the air humidity sensor 84 is greater than or equal to a predetermined air humidity. The predetermined air humidity is determined in advance in accordance with the type of the refrigerant charged in the refrigerant circuit 10 (in this embodiment, R32) and is stored in the storage unit 71. If the controller 70 determines that the humidity of indoor air detected by the air humidity sensor 84 is greater than or equal to the predetermined air humidity, the process proceeds to step S28. On the other hand, if it is determined that the humidity is not greater than or equal to the predetermined air humidity, the process proceeds to step S29.

In R32, distinctive difference in flammability due to a difference in air humidity is not found so much. In contrast, for example, in HFO refrigerants such as HFO-1234ze and HFO-1234yf, the ignition possibility increases as the air humidity increases. Thus, by taking humidity into account, the ignition possibility can be more accurately determined.

In the foregoing, a case has been described as an example in which both the air temperature sensor 83 and the air humidity sensor 84 are used to determine the ignition possibility. However, the ignition possibility may be determined by using the air humidity sensor 84 without using the air temperature sensor 83.

To evaluate the ignition possibility in more detail, the refrigerant gas concentration range condition, the oxygen concentration range condition, the air temperature range condition, and the air humidity range condition may be stored in advance in accordance with the type of the refrigerant charged in the refrigerant circuit 10, and the ignition possibility may be determined specifically in accordance with the type of the refrigerant charged in the refrigerant circuit 10.

(6-5) Modification E

In the embodiment described above, a case has been described as an example in which a refrigerant leak is determined by using the concentration detected by the refrigerant gas sensor 81.

As an alternative for the determination of a refrigerant leak, it may be determined that refrigerant has leaked by, for example, detecting a reduction in the pressure detected by the suction pressure sensor 36 or the discharge pressure sensor 37 (by determining that a predetermined pressure condition is satisfied). In this way, a refrigerant leak is determined by using a detected value of refrigerant pressure in the refrigerant circuit 10, thereby confirming that a leak from the refrigerant circuit 10 has occurred (rather than the detection of refrigerant that has leaked from any other refrigerant system).

Furthermore, for example, in step S10 in the refrigerant leak control mode according to the embodiment described above, the determination is made by both detecting the refrigerant concentration by the refrigerant gas sensor 81 and detecting a reduction in the pressure detected by the suction pressure sensor 36 or the discharge pressure sensor 37, thereby more accurately determining a refrigerant leak to increase reliability. To determine a reduction in the pressure detected by the suction pressure sensor 36 or the discharge pressure sensor 37, a pressure value used as a determination criterion may be stored in the storage unit 71 in advance in accordance with the operation status, and the determination may be made by comparison with the pressure value serving as the determination criterion.

A reduction in the pressure detected by the suction pressure sensor 36 or the discharge pressure sensor 37, described above, may be detected by, for example, detecting a reduction in saturation temperature in the refrigerant circuit 10. In this case, for example, as a reduction in the saturation temperature of refrigerant that flows through the outdoor heat exchanger 23 in the cooling operation mode, a reduction in saturation temperature determined from the outdoor heat-exchange temperature sensor 38 may be detected, or a reduction in saturation temperature corresponding to a saturation pressure determined from the discharge pressure sensor 37.

(6-6) Modification F

In the embodiment described above, a case has been described as an example in which a refrigerant leak is determined by using the concentration detected by the refrigerant gas sensor 81.

Figure 7:
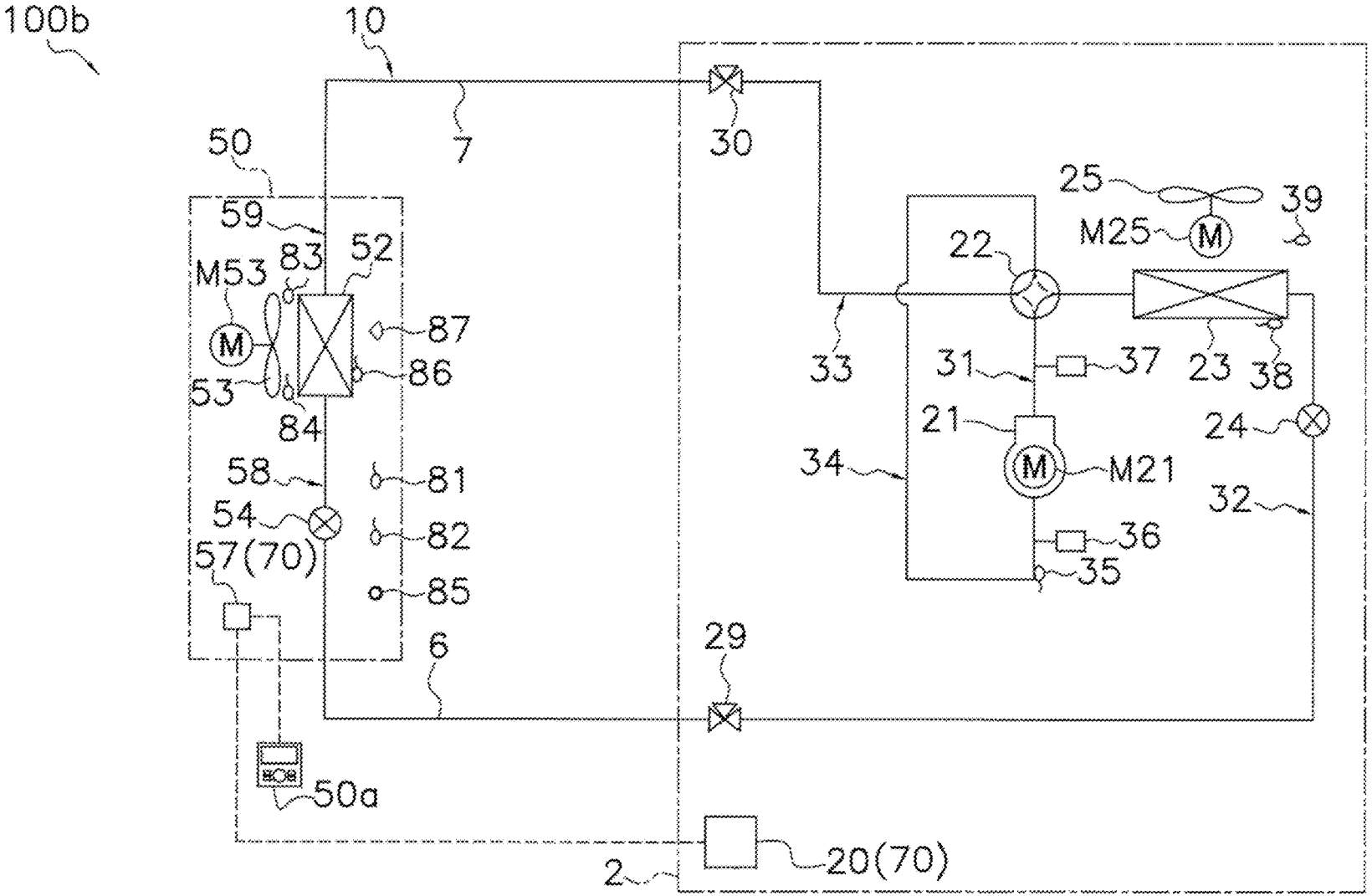
FIG. 7 is an overall configuration diagram of an air conditioner according to Modification F.
Figure 8:
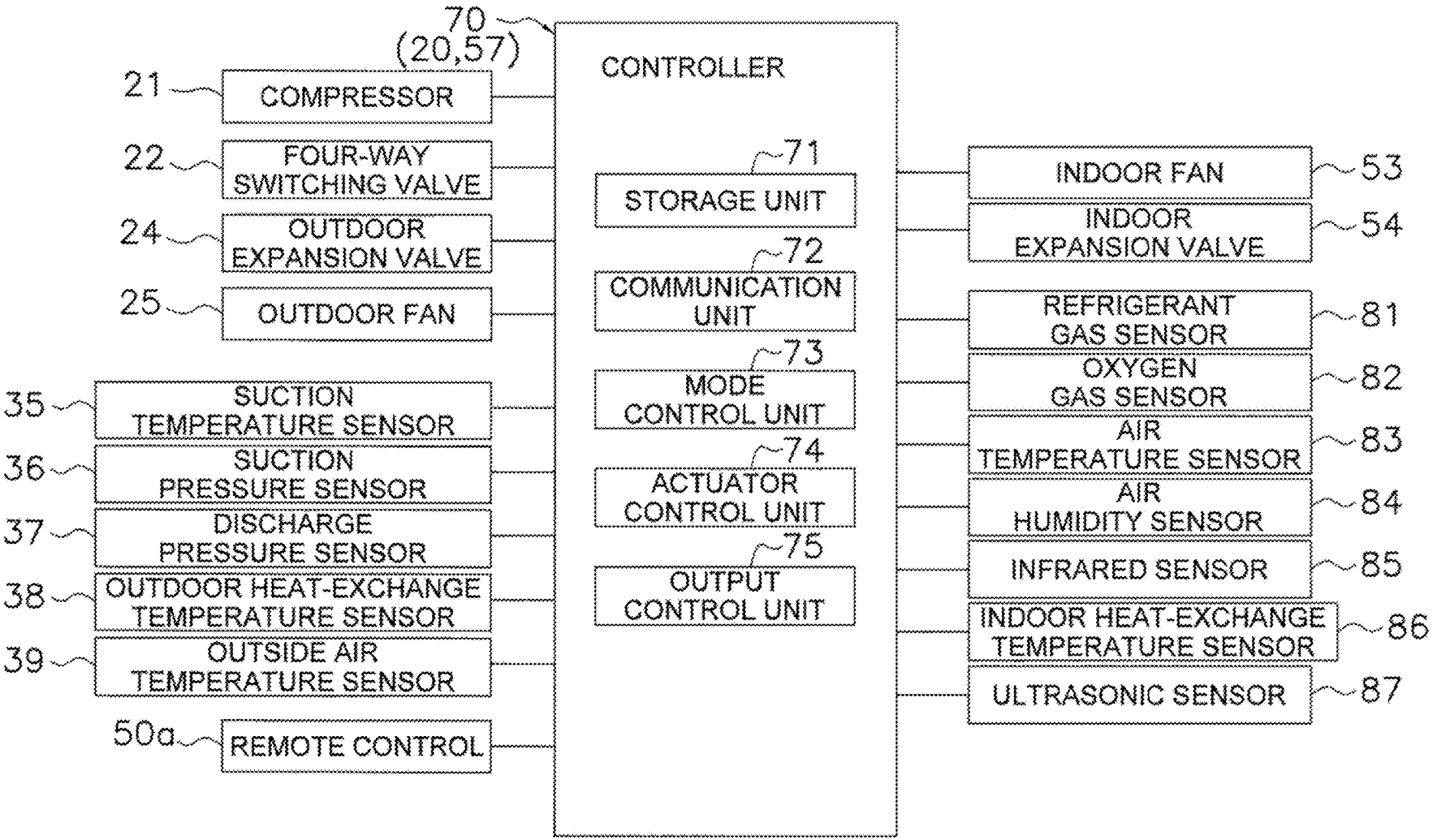
FIG. 8 is a block diagram schematically illustrating the general configuration of a controller according to Modification F and components connected to the controller.

Alternatively, the concentration of refrigerant that has leaked may be determined by using, as illustrated in FIG. 7 and FIG. 8, an air conditioner 100*b* that further includes an ultrasonic sensor 87. The ultrasonic sensor 87 is constituted by an ultrasonic transmitter that emits an ultrasound wave to the interior of the room, and an ultrasonic receiver that receives an ultrasound wave reflected from the wall surface or the like of the room. If refrigerant leaks within the room, velocity changes when the ultrasound wave travels through a portion where the concentration of the refrigerant is high, and the time taken from emission to reception of the ultrasound wave changes accordingly. Based on the change, the refrigerant concentration can be determined. The ultrasonic sensor 87 can compare the specific gravity of refrigerant to be charged in the refrigerant circuit 10 with that of air to predict and use a portion where the refrigerant is likely to build up when leaking, such that the ultrasound wave is emitted downward when the refrigerant has a great specific gravity and the ultrasound wave is emitted upward when the refrigerant has a small specific gravity. The ultrasonic sensor 87 is also electrically connected to the indoor-unit control unit 57 so that a detection signal can be transmitted.

Then, for example, the determination of the refrigerant concentration in step S10 in the refrigerant leak control mode according to the embodiment described above may be performed by using both detection performed by the refrigerant gas sensor 81 and detection of the refrigerant concentration using the ultrasonic sensor 87. In this case, if the value detected by any one of the sensors is determined to be greater than or equal to a predetermined refrigerant concentration, the process may proceed to the subsequent step.

(6-7) Modification G

In the embodiment described above, the air conditioner 100 has been described as an example in which the indoor unit 50 and the outdoor unit 2 are separately arranged in remote locations.

Alternatively, an air conditioner may be configured such that the internal components of the indoor unit 50 and the internal components of the outdoor unit 2 according to the embodiment described above are housed in a single housing, and may be used in such a manner that the single housing is mounted over the indoor side and the outdoor side.

(6-8) Modification H

In the embodiment described above, a case has been described as an example in which if refrigerant leaks, the indoor fan 53 is controlled to forcibly operate with a maximum number of revolutions.

Alternatively, for example, a controller of ventilation equipment, which is installed in the building separately from the air conditioner 100, and the controller 70 of the air conditioner 100 are configured to be capable of communicating with each other, and, when the indoor fan 53 is caused to forcibly operate if refrigerant leaks, a fan included in the ventilation equipment may also be caused to forcibly operate at the same time.

While an embodiment of the present disclosure has been described, it should be understood that configurations and details can be modified in various ways without departing from the gist and scope of the present disclosure as defined in the claims.

REFERENCE SIGNS LIST

2 outdoor unit
10 refrigerant circuit
20 outdoor-unit control unit
21 compressor
23 outdoor heat exchanger
24 outdoor expansion valve
25 outdoor fan
35 suction temperature sensor
36 suction pressure sensor (refrigerant pressure sensor)
37 discharge pressure sensor (refrigerant pressure sensor)
38 outdoor heat-exchange temperature sensor
50 indoor unit
52 indoor heat exchanger
54 indoor expansion valve
57 indoor-unit control unit
70 controller (control unit)
81 refrigerant gas sensor
82 oxygen gas sensor
83 air temperature sensor
84 air humidity sensor
85 infrared sensor (human detecting sensor)
86 indoor heat-exchange temperature sensor
87 ultrasonic sensor
100, 100*a*, 100*b* air conditioner (refrigeration apparatus)

CITATION LIST

Patent Literature

[Patent Literature 1] Japanese Unexamined Patent Application Publication No. 2000-249435

The invention claimed is:

1. A refrigeration apparatus including a refrigerant circuit that has refrigerant charged therein and that performs a refrigeration cycle, the refrigeration apparatus comprising:

a refrigerant gas sensor that detects a refrigerant gas in a target space where at least a portion of the refrigeration apparatus is located;

an oxygen gas sensor that detects an oxygen gas in the target space; and a controller that provides a notification indicating that an ignition possibility has occurred, or changes an operation of the refrigeration cycle in the refrigerant circuit or stops the operation of the refrigeration cycle in the refrigerant circuit, on the basis of detected information obtained from the refrigerant gas sensor and the oxygen gas sensor corresponding to a detected refrigerant concentration and a detected oxygen concentration, wherein the controller compares the detected refrigerant concentration to a predetermined refrigerant concentration and compares the detected oxygen concentration to a predetermined oxygen concentration as preconditions for providing the notification indicating that the ignition possibility has occurred, changing the operation of the refrigeration cycle in the refrigerant circuit or stopping the operation of the refrigeration cycle in the refrigerant circuit.

2. The refrigeration apparatus according to claim 1, wherein the refrigerant charged in the refrigerant circuit is a single-component refrigerant that is one of a flammable refrigerant, a low flammable refrigerant, a mildly flammable refrigerant, and an ammonia refrigerant, or a refrigerant mixture of two or more thereof.

3. The refrigeration apparatus according to claim 1, wherein the refrigerant charged in the refrigerant circuit is R32 or a refrigerant with lower GWP than R32.

4. The refrigeration apparatus according to claim 1, further comprising an air temperature sensor that uses the target space as a detection target space, wherein the controller provides a notification indicating that an ignition possibility has occurred, or changes an operation of the refrigeration cycle in the refrigerant circuit or stops the operation of the refrigeration cycle in the refrigerant circuit, on the basis of detected information obtained from the refrigerant gas sensor, the oxygen gas sensor, and the air temperature sensor.

5. The refrigeration apparatus according to claim 4, wherein the controller performs a first determination based on the detected information obtained from the refrigerant gas sensor and the oxygen gas sensor, and performs a second determination based on the detected information obtained from the refrigerant gas sensor, the oxygen gas sensor, and the air temperature sensor, and provides the notification or changes or stops the operation based on a level of risk of the ignition possibility in accordance with a result of the first determination and a result of the second determination.

6. The refrigeration apparatus according to claim 1, further comprising an air humidity sensor that uses the target space as a detection target space, wherein the controller provides a notification indicating that an ignition possibility has occurred, or changes an operation of the refrigeration cycle in the refrigerant circuit or stops the operation of the refrigeration cycle in the refrigerant circuit, on the basis of detected information obtained from the refrigerant gas sensor, the oxygen gas sensor, and the air humidity sensor.

7. The refrigeration apparatus according to claim 6, wherein the controller performs a first determination based on the detected information obtained from the refrigerant gas sensor and the oxygen gas sensor, and performs a second determination based on the detected information obtained from the refrigerant gas sensor, the oxygen gas sensor, and the air humidity sensor, and provides the notification or changes or stops the operation based on a level of risk of the ignition possibility in accordance with a result of the first determination and a result of the second determination.

8. The refrigeration apparatus according to claim 1, further comprising a fan that generates an air flow in the target space, wherein the controller causes the fan to forcibly blow air on the basis of the detected information obtained from the refrigerant gas sensor and the oxygen gas sensor.

9. The refrigeration apparatus according to claim 1, further comprising a human detecting sensor that detects a moving object in the target space, wherein the controller provides a notification indicating that an ignition possibility has occurred, or changes an operation of the refrigeration cycle in the refrigerant circuit or stops the operation of the refrigeration cycle in the refrigerant circuit, on the basis of detected information obtained from the refrigerant gas sensor, the oxygen gas sensor, and the human detecting sensor.

10. The refrigeration apparatus according to claim 1, further comprising a refrigerant pressure sensor that detects a pressure of the refrigerant in the refrigerant circuit, wherein the controller provides a notification indicating that an ignition possibility has occurred, or changes an operation of the refrigeration cycle in the refrigerant circuit or stops the operation of the refrigeration cycle in the refrigerant circuit, on the basis of detected information obtained from the refrigerant gas sensor, the oxygen gas sensor, and the refrigerant pressure sensor.

11. The refrigeration apparatus according to claim 1, further comprising an ultrasonic sensor that, while outputting an ultrasound wave to the target space, detects a reflected wave of the ultrasound wave from the target space, wherein the controller provides a notification indicating that an ignition possibility has occurred, or changes an operation of the refrigeration cycle in the refrigerant circuit or stops the operation of the refrigeration cycle in the refrigerant circuit, on the basis of detected information obtained from the refrigerant gas sensor, the oxygen gas sensor, and the ultrasonic sensor.

12. The refrigeration apparatus of claim 1, wherein the controller provides the notification, changes the operation of the refrigeration cycle or stops the operation of the refrigeration cycle after determining the concentration of the refrigerant gas detected by the refrigerant gas sensor is greater than or equal to the predetermined refrigerant concentration.

13. The refrigeration apparatus of claim 12, wherein the controller provides the notification, changes the operation of the refrigeration cycle or stops the operation of the refrigeration cycle after determining the concentration of the oxygen gas detected by the oxygen gas sensor is greater than or equal to the predetermined oxygen concentration.

* * * * *